US007963060B2

(12) United States Patent
Arndt et al.

(10) Patent No.: US 7,963,060 B2
(45) Date of Patent: Jun. 21, 2011

(54) PRODUCT DISPLAY DEVICE

(75) Inventors: Keith Arndt, New York, NY (US); John A. Kwap, Newtown, CT (US); Tim Malley, Norwalk, CT (US); Kurt Haldin, New Milford, CT (US)

(73) Assignee: Mechtronics Corporation, White Plains, NY (US)

( * ) Notice: Subject to any disclaimer, the term of this patent is extended or adjusted under 35 U.S.C. 154(b) by 69 days.

(21) Appl. No.: 12/286,891

(22) Filed: Oct. 1, 2008

(65) Prior Publication Data

US 2009/0090037 A1 Apr. 9, 2009

Related U.S. Application Data

(60) Provisional application No. 60/976,607, filed on Oct. 1, 2007.

(51) Int. Cl.
*A47G 29/10* (2006.01)

(52) U.S. Cl. ..... 40/657; 40/503; 40/642.01; 312/125; 211/59.1

(58) Field of Classification Search ..... 40/642.01, 40/503, 494, 657, 514, 515, 517, 493; 211/54.1, 211/57.1, 166, 85.2, 53, 58, 56, 163, 70, 211/78; 186/57; 312/135, 9.45, 9.46, 285, 312/125, 305

See application file for complete search history.

(56) References Cited

U.S. PATENT DOCUMENTS

| | | | | | |
|---|---|---|---|---|---|
| 753,153 | A * | 2/1904 | Lonquist | 312/305 |
| 2,194,238 | A * | 3/1940 | Weaver | 312/125 |
| 3,275,159 | A * | 9/1966 | James et al. | 211/49.1 |
| 3,868,916 | A * | 3/1975 | Ohlson | 108/103 |
| 4,245,414 | A * | 1/1981 | Shypula | 40/124 |
| 5,097,611 | A * | 3/1992 | Smollar et al. | 40/514 |
| 5,397,005 | A * | 3/1995 | Taccolini | 211/70 |
| 5,663,746 | A * | 9/1997 | Pellenberg et al. | 345/581 |
| 5,775,017 | A * | 7/1998 | Morrow | 40/642.01 |
| 6,038,800 | A * | 3/2000 | Seidel | 40/517 |
| 6,581,314 | B2 * | 6/2003 | Valiulis | 40/642.01 |
| 6,675,978 | B2 * | 1/2004 | Shea | 211/59.1 |
| 6,915,914 | B2 * | 7/2005 | Farrand | 211/163 |
| 2003/0000904 | A1 * | 1/2003 | Lung et al. | 211/163 |
| 2006/0225325 | A1 * | 10/2006 | Paulen | 40/503 |

* cited by examiner

*Primary Examiner* — Joanne Silbermann
*Assistant Examiner* — Kristina Staley
(74) *Attorney, Agent, or Firm* — Michaud-Kinney Group LLP

(57) ABSTRACT

A product display device includes a support frame, a plurality of placard devices, a pair of carousel display devices and a messaging unit disposed between the pair of carousel display devices. The placard devices, the carousel display devices and the messaging unit providing an integrated display of products to prospective consumers. The messaging unit including a removable interactive display for providing at least one of textual, graphic, image, pictorial and visual illustrations and representations of product information and promotional information to prospective customers.

20 Claims, 15 Drawing Sheets

200

PRODUCT DISPLAY DEVICE

CROSS-REFERENCE TO RELATED APPLICATIONS

This patent application claims priority benefit under 35 U.S.C. §119(e) of U.S. Provisional Patent Application Ser. No. 60/976,607, filed Oct. 1, 2007, the disclosure of this U.S. patent application is incorporated by reference herein in its entirety.

BACKGROUND OF THE INVENTION

1. Field of the Invention

This invention relates to merchandise and/or product display systems and, in particular, to reconfigurable product display systems.

2. Description of Related Art

In a retail environment, consumers wish to quickly locate a product that they desire from among other products in a display and to easily remove the desired product from the display. Retailers and consumers face several challenges regarding the display of products, because so many products resemble other products even though they are not substitutes for each other. In addition, retailers need to easily arrange and rearrange the products on the display for aesthetic purposes and/or to facilitate restocking the display.

Typically, a product package, for example, a package for a battery, has information on it to specifically identify the product contained therein. As discussed in U.S. Pat. No. 6,244,444, to Jacobus, et al., granted Jun. 12, 2001, entitled "Peggable Reclosable Battery Package," the disclosure of which is incorporated by reference herein in its entirety, there are a number of battery types that are identified by voltage, current, and dimensional criteria. Most common among these battery types are round cell batteries, readily available sources of direct current packaged in cylindrical canisters. The round cells have been given letter designations and range, in physical size, from AAAA, AAA, AA, and C to D. Also commonly used in conventional consumer products is the non-cylindrical 9V battery. Battery manufacturers label their products and product packages according to the standard sizes AA, AAA, etc., and often design battery packages for preferred display systems. The standardization of battery sizes and properties allow consumers an ability to replace the batteries in their electronic devices from the stocks of thousands of retailers throughout the world, for example, convenience stores, hardware stores and electronic shops. However, while the various kinds of batteries are often similarly packaged, they are not interchangeable. Therefore, consumers must take care to precisely select the battery that they need.

When a retailer offers a variety of batteries for sale, it is standard marketing practice to group the various types of batteries together in one area of a display. Retailers face an ongoing challenge to design battery displays that allow consumers to quickly find the batteries that they need despite the similarity of battery packages of various size batteries. Such challenges are presented in the sale of other product lines that include similarly packaged but non-interchangeable products.

In general, a retailer uses a product display system that includes a product support device that has multiple locations for different products. The product display system also includes product designators (placard devices) to label the locations on the product support device where particular products are to be displayed, and to provide information about those products. The placard device includes a rectangular placard for displaying product information. Typically, the product information displayed on the rectangular placard includes, for example, the product's commercial name, UPC/SKU code, price, size, etc. Such information is used by retailers and consumers for purposes of stocking the display system, taking inventory and for providing pricing and other information to consumers. Consumers use product information on placards to locate desired products on the display system and to learn the retailer's price. To avoid customer confusion, errors in inventory control and other vagaries of retail sales practice, it is necessary for retailers to carefully compare the product information on a product package with the information on the placard to assure that the placard matches the product associated therewith. After a product display is initially set up, it may be necessary or desirable to replenish, rearrange, or move products in the display. During such activities, it is important to ensure that the placard devices and products associated therewith remain properly associated with each other. Retailers often prefer reconfigurable product display systems, that is, systems that include product support devices that are configured in various ways to permit variation in the placement of products thereon.

A basic type of reconfigurable product support device is a shelving system in which several shelves are supported on a frame. In typical use, a retailer places product designators on a shelf to label portions of the shelf for specific products. A shelving system may be reconfigurable in that it may allow for vertical adjustment of the shelves, so that the retailer may raise and/or lower one or more shelves on the frame to accommodate products of various sizes. A placard device for a shelving system may include a placard and an attachment device on which the placard is mounted. The attachment device may be adhesive, or a clip or other structure, for mounting at or on an outward edge of the shelf. For example, a conventional front-fence type placard device 130 for a shelf 132 is shown in FIG. 1A. The placard device 130 has an L-shaped configuration that includes a base 130*a* by which the placard device 130 is attached to the front of the shelf 132 by a screw 134. The placard device 130 has an upward-extending placard 130*b* for displaying product information.

Shelving systems offer limited options for product display and display rearrangement. For example, a shelf often holds more that one type of product, and often holds products of various sizes. Therefore, the shelf must be positioned to accommodate the largest (tallest) item on the shelf. As such, there is a significant amount of "dead" space above the other products on shelf. In addition, it is typically necessary to completely clear the shelf before it can be moved, which makes moving the shelf a tedious and/or time-consuming. Moreover, the number of positions provided on a shelving frame is limited. Shelving systems have other drawbacks as well. For example, as products are removed from the shelves by customers, the visual appeal of the product display declines. In some instances, customers remove and then replace products on the shelf, but place the products near the wrong product designators, making the display confusing for others as well as visually unappealing.

Another type of reconfigurable product display system that is known in the art is a pegboard display system, which includes, as the product support device, a perforated board (sometimes referred to as a "pegboard") and pegs that are moveably mountable on the board. In use, products are suspended on the pegs. Pegboard display systems offer an improvement relative to shelving systems because the number of possible positions for a peg on the board is generally much greater in both horizontal and vertical directions than the number of possible positions for an adjustable shelf on a frame. Therefore, for a given vertical area of display, a pegboard display system offers the possibility of permitting a greater number of horizontal rows of products than a shelving system. In addition, there is much greater flexibility in creating a display for products of various sizes, so the retailer can easily avoid creating a display that has dead space in it.

Placard devices for product information are also used with pegboard display systems. For example, a placard device may include a placard mounted on a boom member, where the boom member is mountable on the pegboard above the product peg to provide information to the consumer and/or retailer about the product on the peg. A prior art peg and placard device combination 100 is shown in FIG. 1B. The combination 100 includes a standard product peg 110 having a hook end 112 for engaging perforations in a pegboard and an arm 114 extending from the hook end 112 for supporting products hanging thereon. A placard device 120 is removably mountable near the peg 110 so that the placard device 120 can be associated with the peg 110 and with any products on the peg 110. For a placard device 120 to be associated with the peg 110, the placard device 120 is the closest placard to the end of the peg 110. In this case, the placard device 120 includes a foot portion 122 that is configured to engage the hook end 112 of the peg 110 and a rectangular placard 124 on a distal end of a boom member 126. The boom member 126 extends from the foot portion 122 towards the end of the product peg 110. In this way, the placard device 120 is positioned so that as a product is slid past the end of the peg 110, the product information on the placard 124 can be compared to the product information on the product package or to the product itself. Similar placards are used with other type of product displays, such as shelves.

One battery package for use in a pegboard display system is shown in U.S. Pat. No. 5,823,350, to Ward, granted Oct. 20, 1998, entitled "Paperboard Security Battery Package," the disclosure of which is incorporated by reference herein in its entirety. Typically, with the use of such packages, batteries of a common type are displayed in proximity to each other. For example, all the "AA" batteries stocked on a product display are typically on a common peg and are adjacent to packages "AA" batteries on another peg, such as in a single column or row of pegs.

As described above, display systems having associated product information placards are known in the art. For example, U.S. Pat. No. 4,343,405, to Virte, et al., granted Aug. 10, 1982, entitled "Universal Mountable Display Tray," discloses a display tray for consumer products having a plurality of pivotable support means for securing the tray on various width slats and various "peg-board" type support walls. Space for a small rectangular information placard is provided at the end of the tray.

U.S. Pat. No. 6,244,444, to Jacobus, et al., granted Jun. 12, 2001, entitled "Peggable Reclosable Battery Package," discloses a re-closable battery package that is designed for display on a pegboard.

U.S. Pat. No. 7,131,543, to Mason, granted Nov. 7, 2006, entitled "Display Device," discloses a display device for modular merchandise units. The display device provides a series of shelves in a housing on a substantially flat base, with at least one wheel connected to the base. The shelves are permanently positioned in the housing.

Generally speaking, the rectangular prior art placards include so much information that consumers have difficulty in finding pertinent items of information, such as the product species, from among all other product information on the placard, to enable them to precisely select the product that they want.

The inventors have discovered that conventional product display systems do not adequately exhibit product information. For example, a need exists for a more visually apparent way of exhibiting product information and, in particular, distinctive features and/or characteristics of the products within the display. Retailers also need display systems that are reconfigurable and easy to use.

Based on the foregoing, it is the general object of this invention to provide a product display system that improves upon, or overcomes the problems and drawbacks of, prior art product display systems.

SUMMARY OF THE INVENTION

The present invention resides in one aspect in a product display device including a support frame, a plurality of placard devices, a pair of carousel display devices and a messaging unit disposed between the pair of carousel display devices. The placard devices, the carousel display devices and the messaging unit providing an integrated display of products to prospective consumers. The messaging unit including a removable interactive display for providing at least one of textual, graphic, image, pictorial and visual illustrations and representations of product information and promotional information to prospective customers.

In one embodiment, the messaging unit includes a message housing, a removable display disposed in the message housing and a shelf-talker display disposed in the removable cassette.

DETAILED DESCRIPTION OF PREFERRED EMBODIMENTS

In one aspect of the present invention, a placard device for a product display system includes a placard having a product information region and a featured information region. The placard may be associated with a product support device, such as a pegboard display system, a shelving system, or the like, on which a product may be displayed. The invention enables customers seeking a product on the product support device to more easily find the specific product they want. The invention also enables retailers to more easily load products onto the product support device and rearrange products thereon than with prior art product display systems.

Figure 1A:
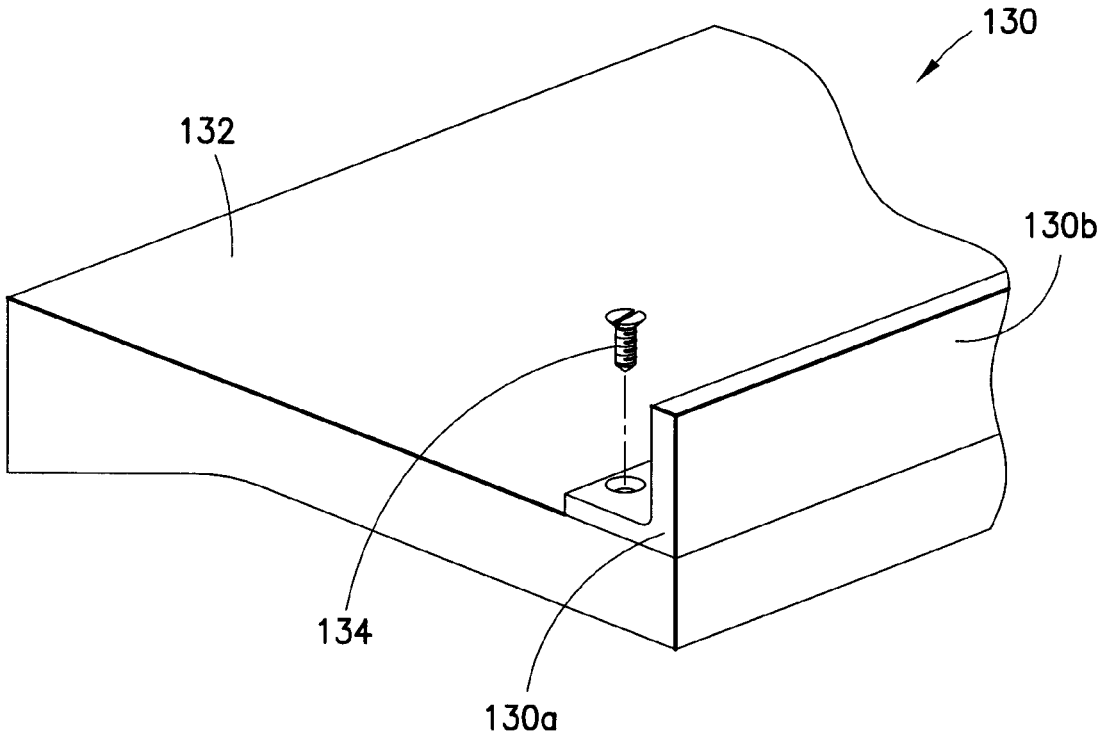
FIG. 1A PRIOR ART
FIG. 1A is a perspective view of a product support self member and placard device according to the prior art.
Figure 1B:
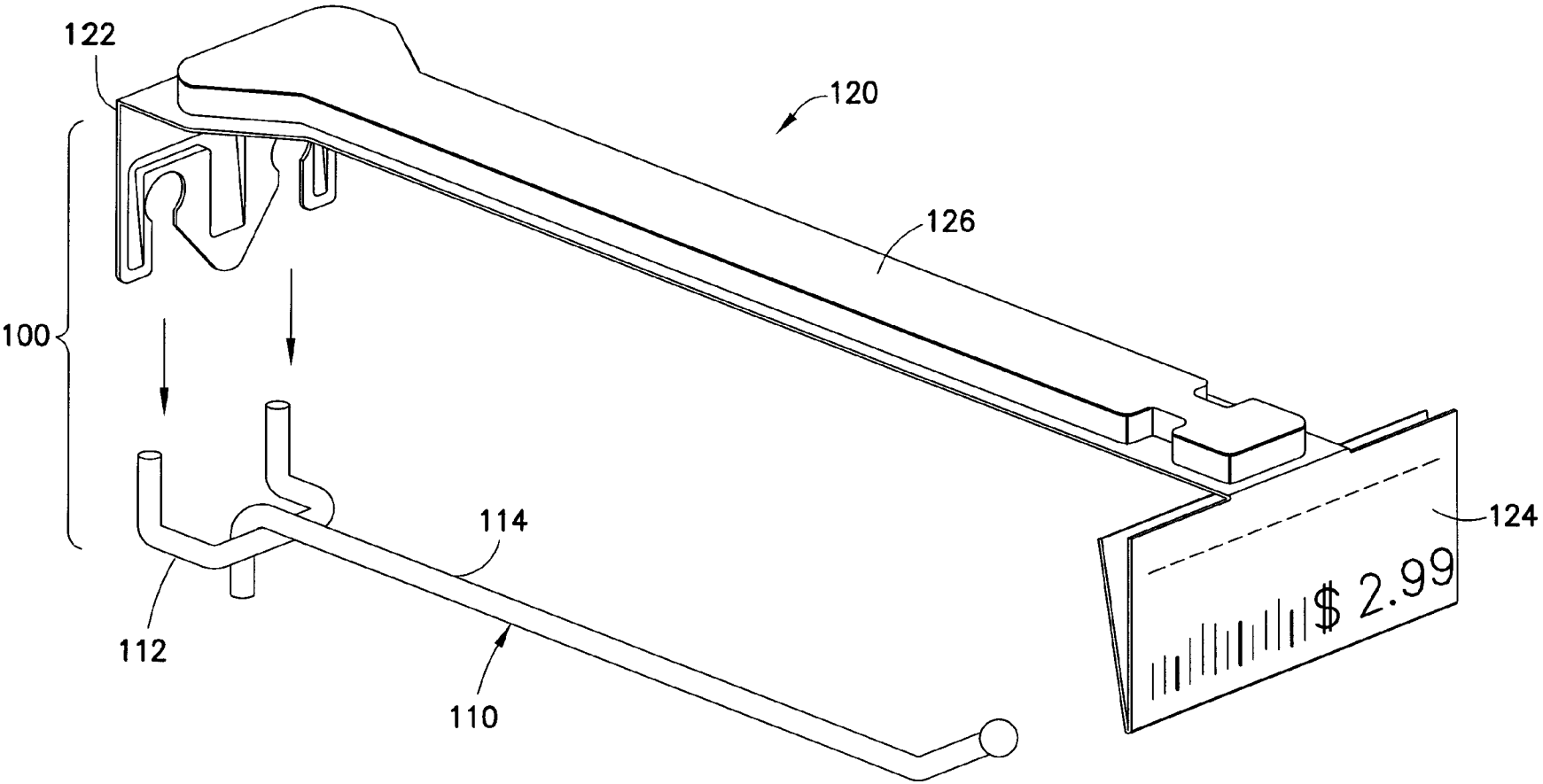
FIG. 1B PRIOR ART
FIG. 1B is an exploded perspective view of a product display peg and placard arm according to another embodiment of the prior art.

As noted above, a prior art placard device 100 for a pegboard display system is shown in FIG. 1B. The placard device 100 provides only a product information region 124 in the placard 100 at the distal end of the boom member 126. The product information region 124 is typically rectangular and displays numerous types of product information including, for example, the product UPC/SKU code, a scannable bar code, and textual information including the product name and price. With so much information on the product information region 124, it is often difficult for consumers to use the product information region 124 to locate the product they want from among the others on the same pegboard display. As discussed below, the most common information wanted is product species information (e.g., battery size or other properties of the product). In addition, great care must be exercised by the retailer when loading and re-loading product on the display, so that the product loaded on the peg matches the product identified on the product information region 124. Due to the quantity of information on the limited product information region 124, great care must also be taken in placing the pegs and placard arms on the pegboard to assure that like products are placed together, e.g., that all of the "AA" batteries are grouped together in a same area of the pegboard display system.

Figure 2:
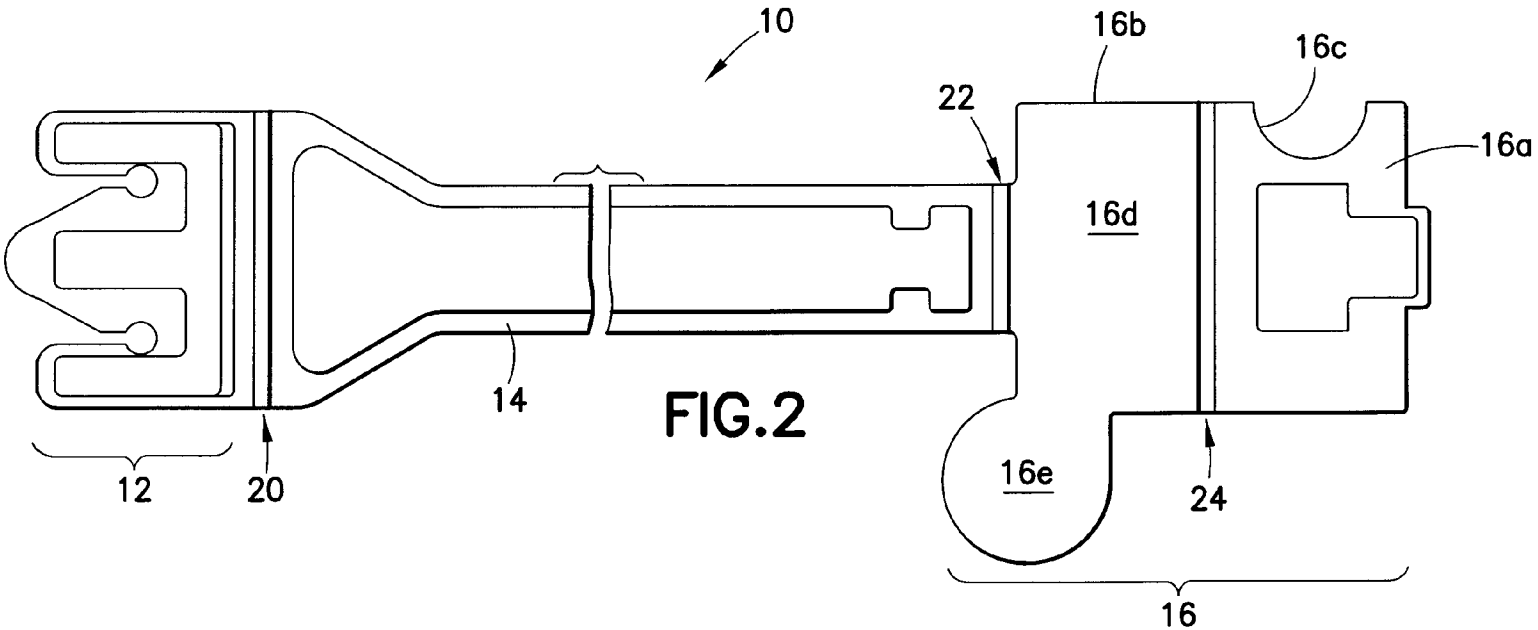
FIG. 2 is a plan view of a placard arm for use according to a particular aspect of the invention.
Figure 3:
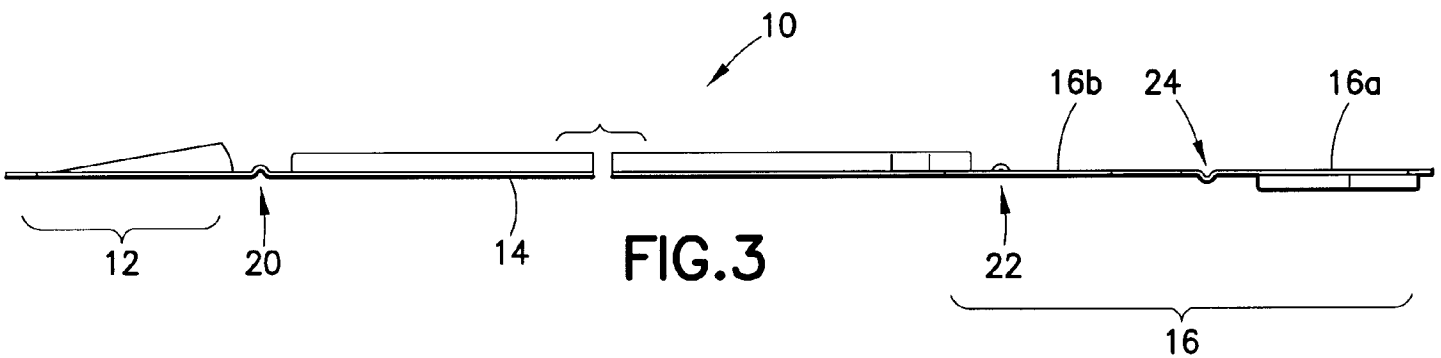
FIG. 3 is a view of the placard arm of FIG. 2, taken on line 3-3.

One aspect of the invention makes use of a novel placard configuration in a placard device. One embodiment of a placard device 10, in accordance with the present invention, is seen in FIG. 2 and FIG. 3. In one embodiment, the placard device 10 is formed from a moldable material in a molding process, e.g., an injection molding process, and comprises a foot portion 12, a boom portion 14 and a placard 16. The foot portion 12 is configured to be removably mountable on a pegboard near an associated peg. For example, the foot 12 is configured to engage a hook end 112 of a standard product peg (FIG. 1B). The boom 14 is joined to the foot 12 by a proximal hinge 20, and the placard 16 is joined to the boom 14 by a distal hinge 22. In one embodiment, the placard 16 has two parts joined together by a placard hinge 24. The hinged configuration of the placard allows for the creation of a placard sleeve by folding a rear portion 16*a* of the placard 16 against a front portion 16*b*. In one embodiment, the front portion 16*b* is transparent and of a suitably size for receiving a card bearing product information inserted into the placard sleeve. A cutout 16*c* in the rear portion 16*a* facilitates removal of the card so that the card can be replaced should the product information need to be updated or changed. While the placard sleeve is described as being formed by folding two parts (rear portion 16*a* and front portion 16*b*) of the placard 16, it should be appreciated that in one embodiment, the placard sleeve is formed as a one piece construction.

When the placard device 10 is mounted on a peg (e.g., peg 110) that is mounted on a pegboard, the foot 12 is disposed vertically. The boom 14 is angled from the foot by the proximal hinge 20 and extends from the pegboard, for example, above and along a length of the peg 110. The placard 16 is angled from the boom 14 by the distal hinge 22, is positioned near the distal end of the peg, and extends down so that information within the placard sleeve is visible about the distal end of the peg. As shown in FIG. 2, the placard 16 includes a rectangular product information region 16*d*. The rectangular product information region 16*d* is of a size suitable for displaying all the necessary product information required by consumers and the retailer for the various purposes of stocking the pegboard, taking inventory, providing pricing and other information to consumers, as is known in the art. In accordance with the present invention, the placard 16 also includes a featured information region 16*e* for prominently displaying a specific item of the product information, e.g., the product species. The species information of a product is that a feature or characteristic of each product in a line of products that is used by consumers in selecting a particular product from a full line of similar products. For example, a product species of a line of battery products is the battery size; the species of a line of shoe products is the shoe size, etc. The prominently displayed product information may also appear on the product package, but it might not, or it might be difficult to find upon causal or hurried inspection, so the featured information area 16*e* provides the consumer's (and the retailer's) a more useful presentation of the information. It should be appreciated that the featured information may also or alternatively include promotional information (e.g., a discount price) or other information for individually identifying a subset of products from a product line such as, for example, a low calorie food item from within a category of foods (or other nutritional value information), a product having a desirable product rating (e.g., a freshness or organic certification), and the like.

In accordance with the present invention, the featured information region 16*e* is configured to distinguish the region 16*e* from the product information region 16*d*. For example, in one embodiment illustrated in FIGS. 2-4, the product information region 16*d* is rectangular and the featured information region 16*e* is a substantially circular pendant disposed adjacent to the rectangular area 16*d*. It should be appreciated that it is within the scope of the present invention for the featured information region 16*e* to be configured as any other shape, color and the like, to distinguish the featured information region 16*e* from the product information region 16*d*. In one embodiment, the featured information region 16*e* includes one of a plurality of predetermined colors, where each color represents one of a plurality of species in a product line. For example, it is known to color code particular species of hearing aid batteries such that different sizes of hearing aid batteries may be identified by one or more of a color code and a numeric size code. It is within the scope of the present invention for the featured information region 16*e* to reflect one or more of the color codes and the numeric code of the hearing aid batteries such that different sizes of batteries can be more easily recognized by prospective consumers.

In accordance with the present invention, the featured information region 16*e* is used to prominently display the featured product information that individually identifies each species within the product line. The inventors have discovered that prominently displaying the species information is helpful to both the consumer and the retailer. For example, for a pegboard display of a line of battery packages, the featured information region 16*e* prominently displays particular battery sizes, "AA", "AAA," etc. The product species information may be displayed also in the rectangular product information region 16*d*, but the species information can be difficult to quickly discern amidst all the other information typically included on a product placard. The inventors have discovered that by providing a featured information area specifically for the prominent display of product species information, the use of the product placard is greatly improved.

Figure 4:
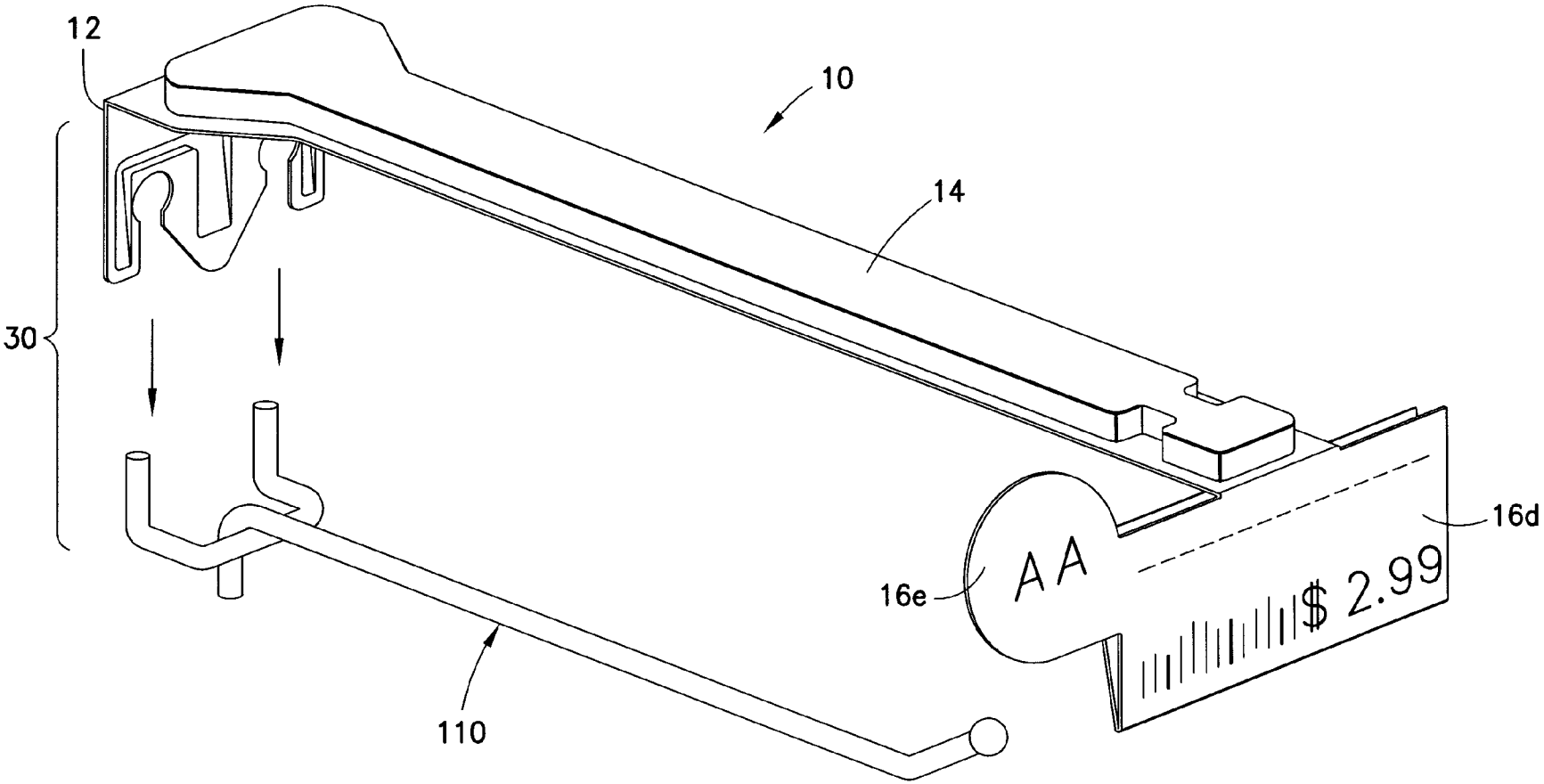
FIG. 4 is an exploded perspective view of a product display peg and placard arm for use according to a particular embodiment of the present invention.
Figure 8B:
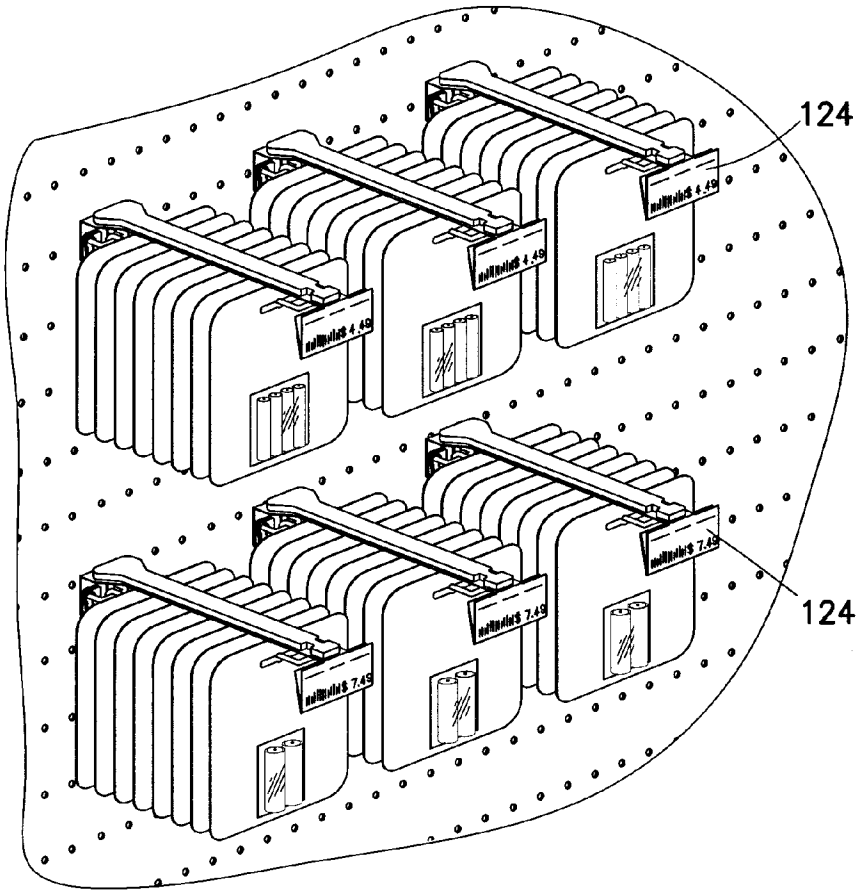
FIG.8B PRIOR ART
FIG. 8B depicts a plurality of prior art product display pegs and placard arms.
Figure 8A:
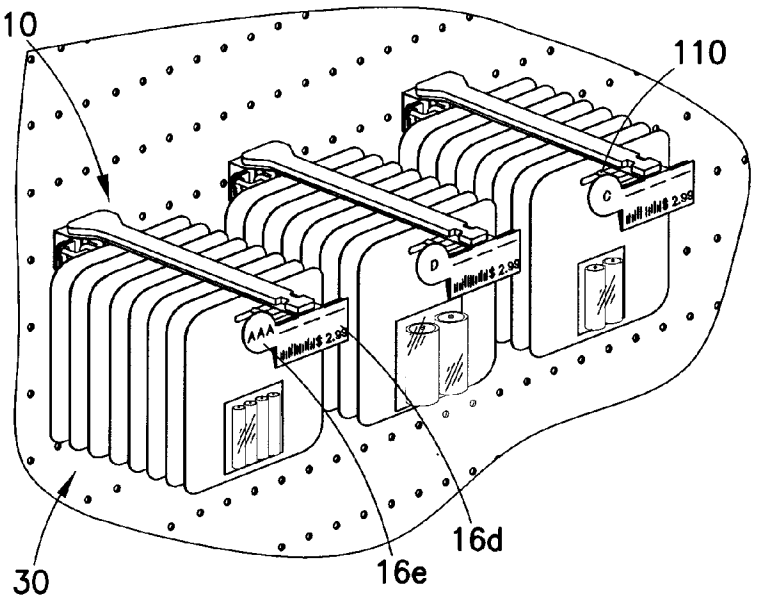
FIG. 8A depicts a plurality of the product display pegs and placard arms of FIG. 4 exhibiting a plurality of products of a line of products to prospective consumers.
Figure 9A:
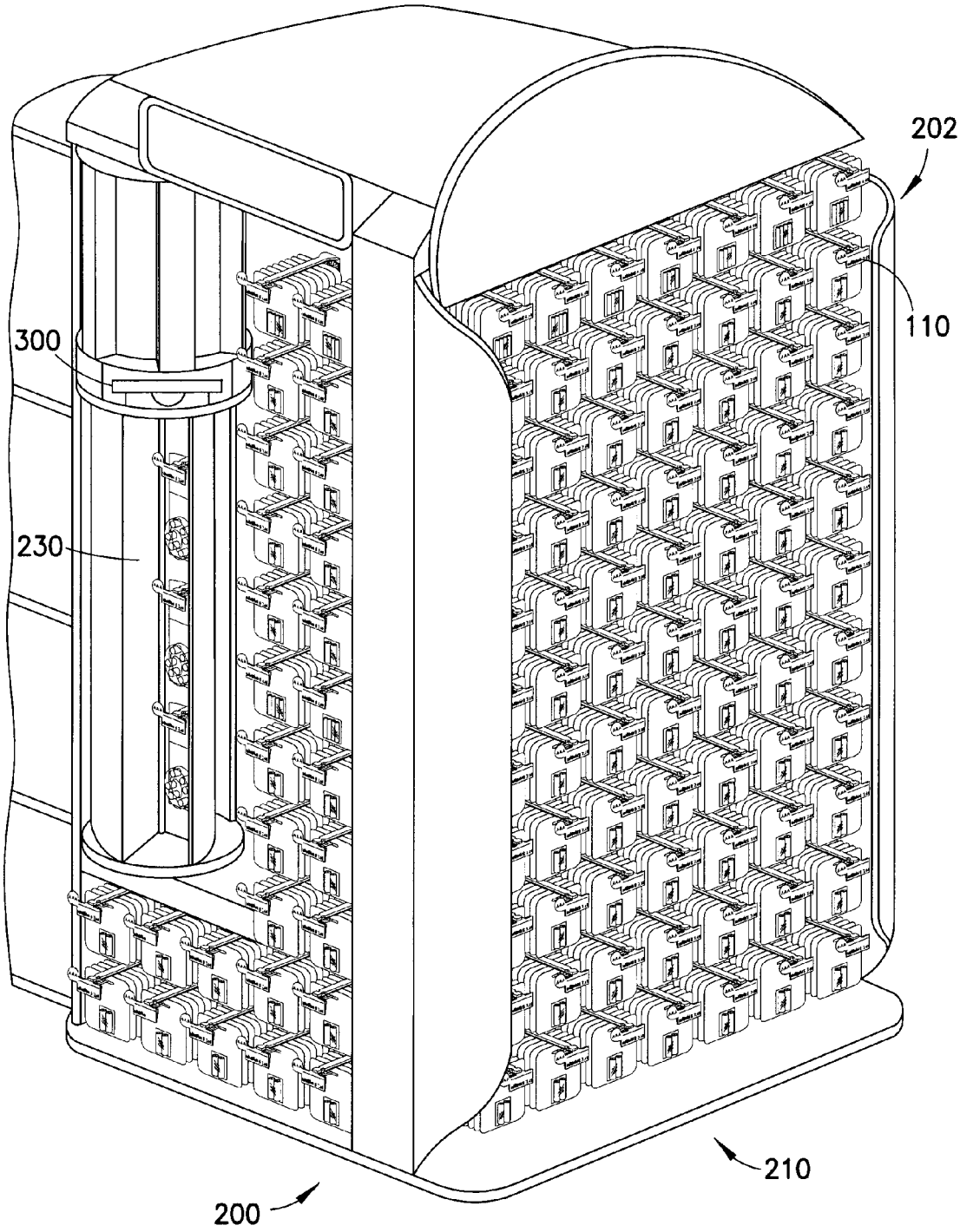
FIGS. 9A and 9B are left and right hand perspective views of an end cap merchandising device incorporating, in accordance with one embodiment of the present invention, the inventive placard device and a plurality of inventive carousel display device.
Figure 9B:
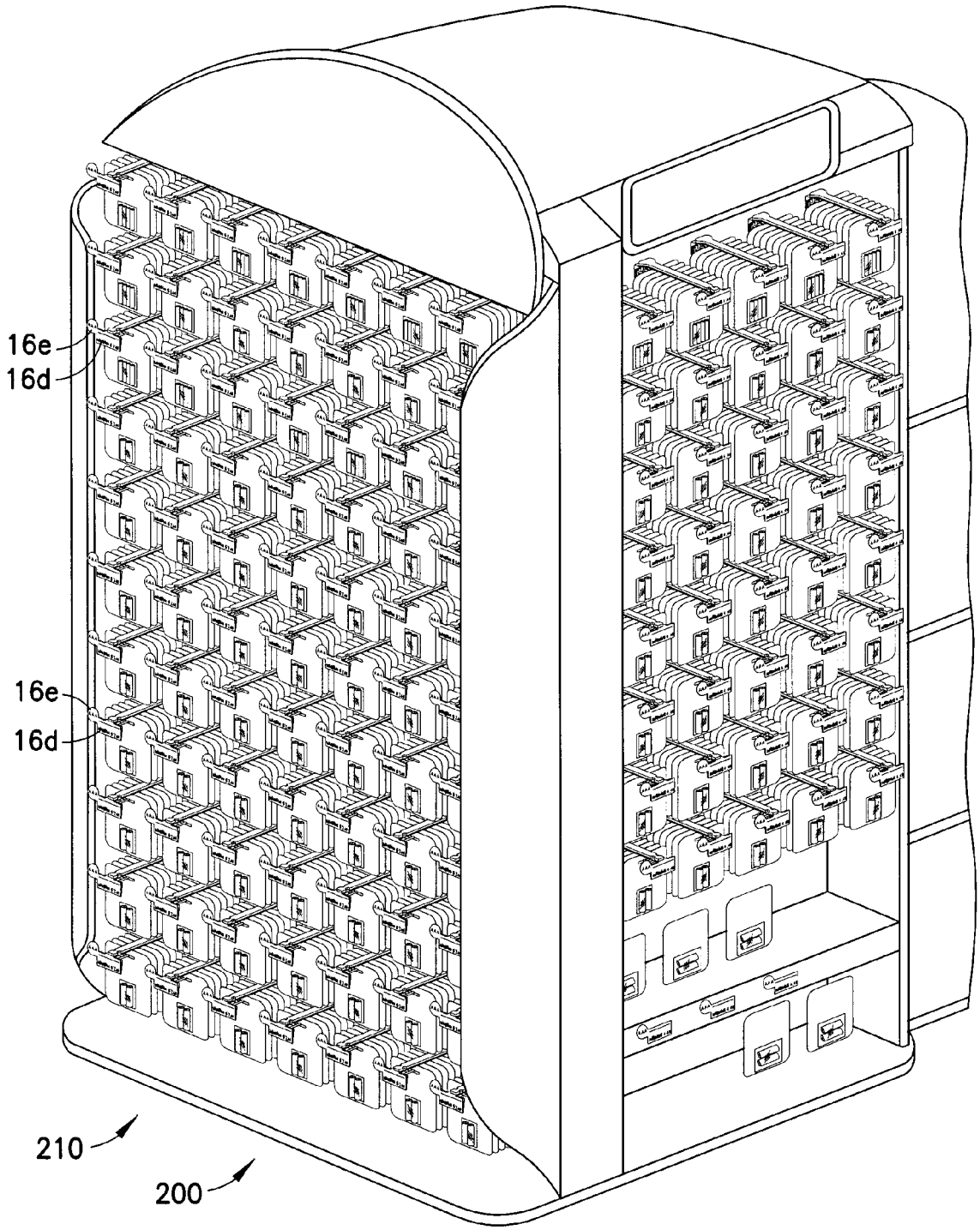
Figure 9C:
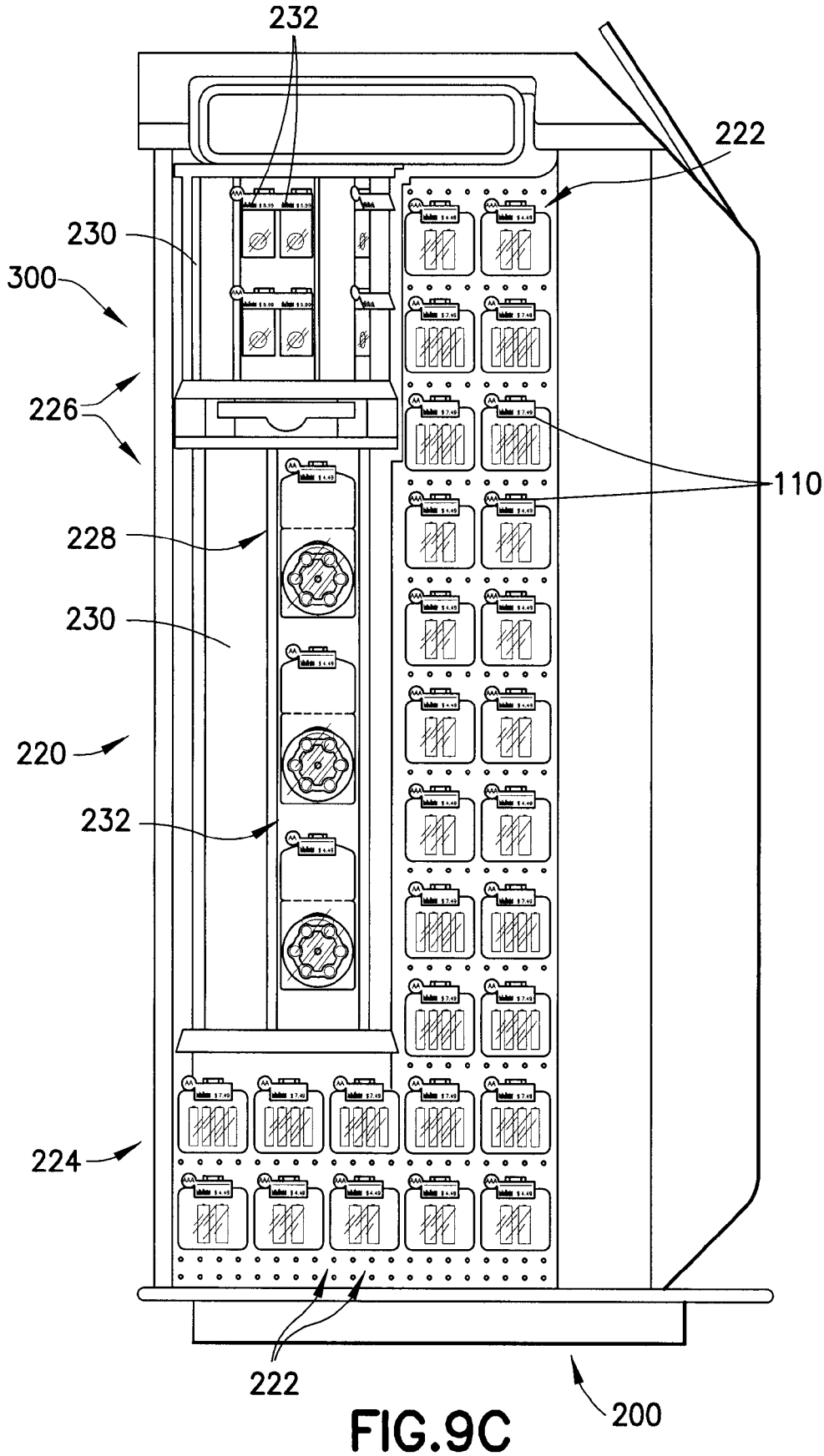
FIG. 9C is a left hand side elevational view of the end cap merchandising display device of FIGS. 9A and 9B.
Figure 9D:
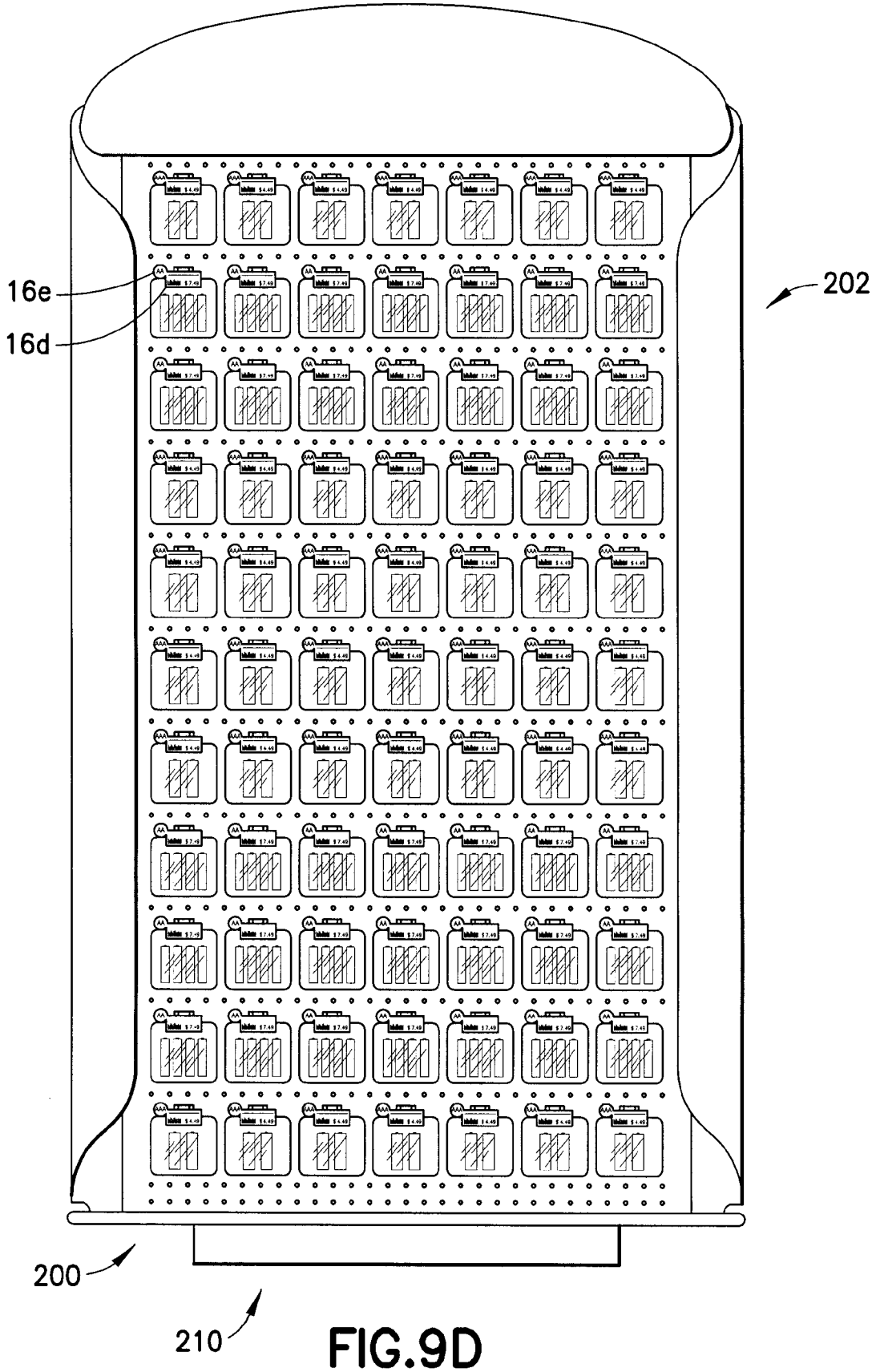
FIG. 9D is a front elevational view of the end cap merchandising display device of FIGS. 9A and 9B.
Figure 9E:
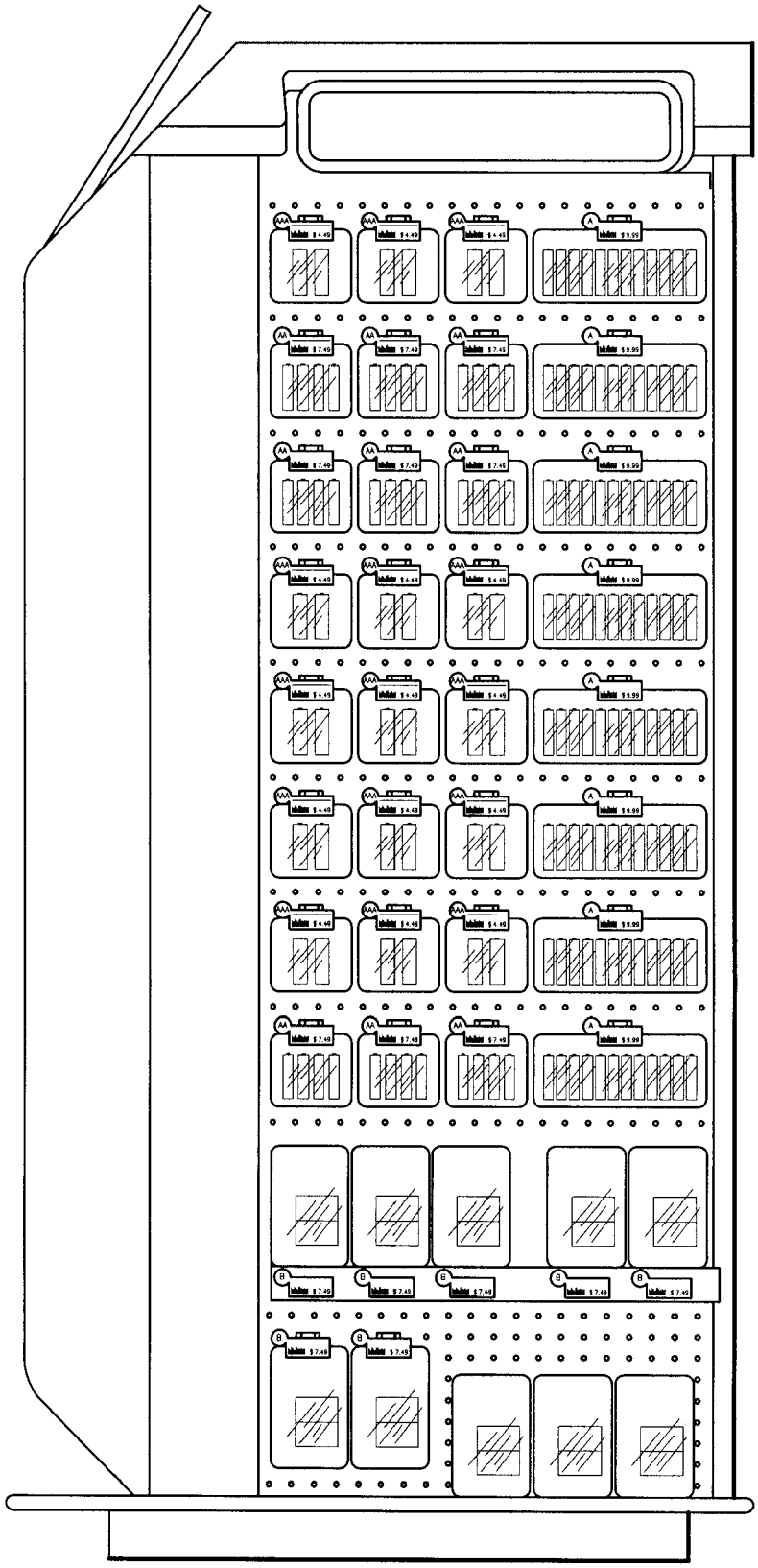
FIG. 9E is a right hand side elevational view of the end cap merchandising display device of FIGS. 9A and 9B.

As seen in FIGS. 4 and 8A, the placard device 10 can be used with a standard product peg 110 to provide a novel peg display 30. By prominently displaying the product species on the featured information region 16*e* of the placard 16 and associating the placard device 10 with the peg 110, the use of the placard device 10 on a pegboard display system facilitates the retailer's task of stocking the peg with product and facilitates the consumer's task of selecting a desired product from within a line of products having differing features or characteristics. As shown in FIG. 8A, it is within the scope of the present invention for the featured information region 16*e* to be configured utilizing a different color scheme than is used for the product information region 16*d* to even further distinguish the featured information region 16*e* from the product information region 16*d*. FIG. 8B provides a comparative view of a conventional retail battery pegboard display comprising pegs and prior art placard devices like those of FIG. 1B. As illustrated in the side-by-side comparison of FIGS. 8A and 8B, the featured information region 16*e* of the present invention provides a more visible display of information (e.g., product species information) to prospective consumers to assist in the location, selection and purchase of desired products. A few perceived benefits of the display are described further below.

Since consumers often have the featured information in mind when viewing a product display, providing a featured information region 16*e* that is physically and, optionally, visually distinct from the information on the rectangular product information region 16*d* not only helps consumers identify the product they want, it also helps consumers de-select (that is, disregard) similar products in the display that do not meet the consumers' needs. De-selection is facilitated because the consumer can quickly determine that the other, similar products are not the ones they want, despite visual similarity of the product or product package.

The product selection or de-selection processes are further enhanced by providing important product information (e.g., the product species information) of all the related products on a unique, common visual plane. Having the important information on a common plane facilitates a consumer's visual search on that plane. Since the information is presented on a plane that is separate from the product packages, any variability of the product packages does not distract the consumer or the retailer from finding the information. Without providing the information in a common plane, it would be necessary to look to the forward item on each peg, and the forward item on various pegs may be at different positions on the pegs (e.g., depths), leading to visual confusion.

The inventors have discovered that it is also helpful that the placards have uniform configurations so that the featured information appears at a consistent location on each placard. Providing consistency in the display of the featured information helps consumers and retailers in locating the information on each placard and helps in comparing featured information from one placard to the featured information on another placard. In addition, consistency of configuration of the placards for the display of featured information alleviates the visual confusion that arises in a display of interchangeable good when different manufacturers of those goods display the species information in different ways. For example, even among battery manufacturers who provide size information (e.g., "AA" battery size information) prominently on their battery packages, there are differences as to the location and the presentation of the information (color, font style and size, quadrant where the information is provided on the packaging, etc.) which makes a display based solely on product packages visually crowed and complex. As a result, a consumer could be misled into overlooking a product that would meet their needs. By presenting the information in a uniform manner, the product display avoids such crowded, complex and/or misleading displays of information.

Figure 5:
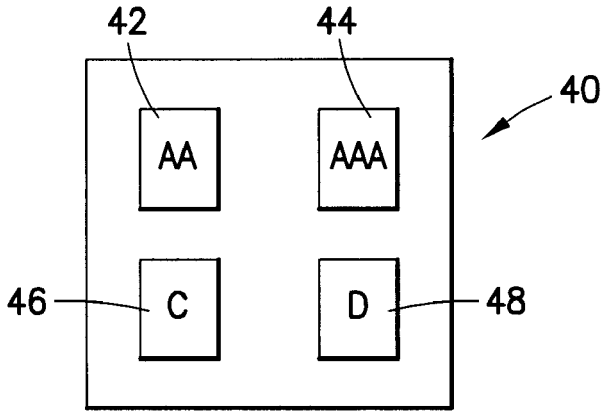
FIG. 5 is a schematic elevation view of a battery pegboard display according to one aspect of the invention.

To create a product display, a retailer mounts peg displays 110 on a pegboard. When there are multiple pegs 110 for displaying products of the same species, the pegs 110 are preferably grouped together by product species. For example, as depicted in FIG. 5, a pegboard display 40 of a product line of batteries may have a first group 42 of AA battery peg displays, a second group 44 of AAA battery peg displays, a third group 46 of C battery peg displays, and a fourth group 48 of D battery peg displays. As is shown in FIG. 8A, the featured information region 16*e* particularly highlights individual species (differing battery sizes) within the product line of batteries.

Figure 7:
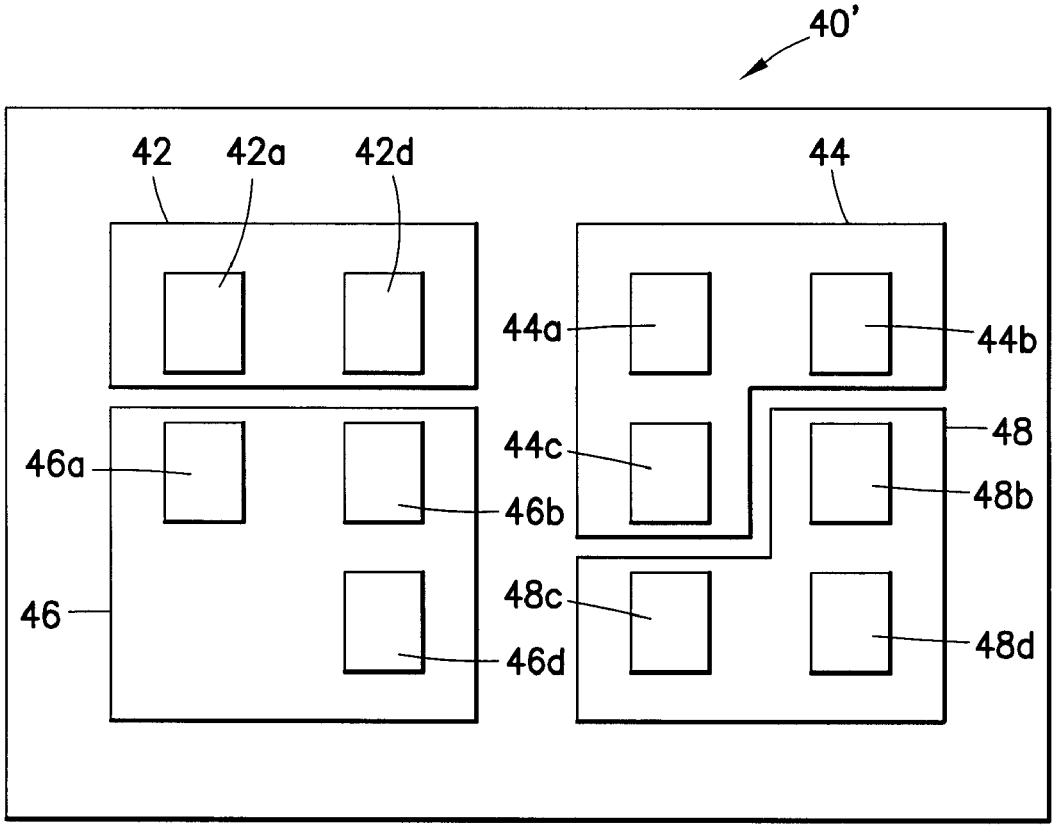
FIG. 7 is a schematic elevation view of the display of FIG. 6 after rearrangement.
Figure 6:
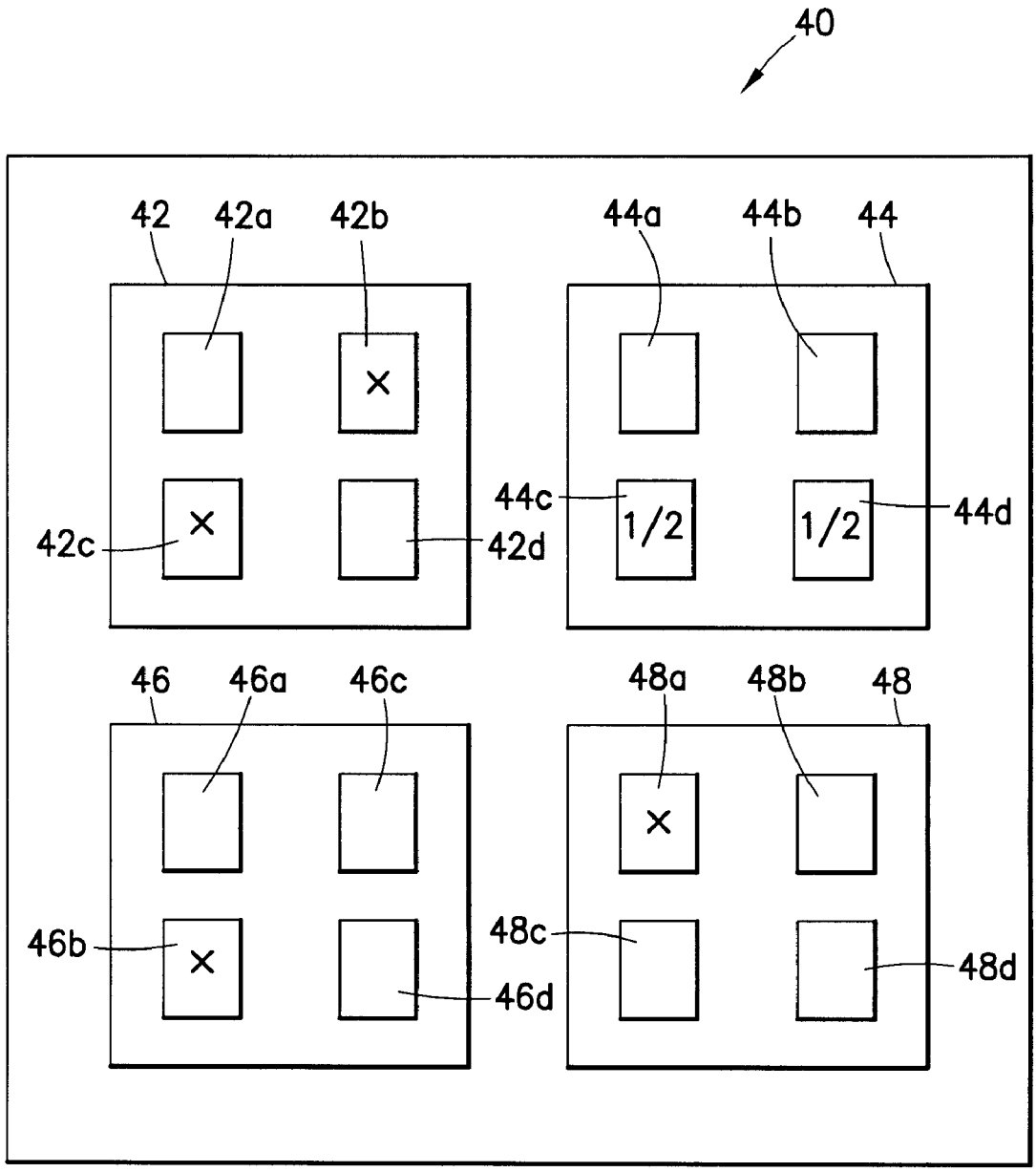
FIG. 6 is a schematic elevation view of the display of FIG. 5 in need of rearrangement.

When a product display needs (or it is desired) to be rearranged on the pegboard, this is easily accomplished as well. For example, sales of particular batteries may result in the display 40 of FIG. 5 looking "unkempt" due to a relative emptiness in a particular region of the display 40. The emptiness may be due to the complete absence or partial absence of product on one or more pegs in the display 40. For example, each of groups 42, 44, 46 and 48 may comprise four peg displays a-d, respectively, as indicated in FIG. 6. After a number of sales, two displays of group 42 (42*b*, 42*c*) and one display in each of groups 46 and 48 (46*b*, 48*a*) are empty (indicated by "X's" in the FIG. 6), and two displays in group 44 (44*c*, 44*d*) may be half-full (as indicated by the "½" label). In such case, the retailer may wish to consolidate the goods on the display 40 to eliminate unattractive visual "holes" in the display. Consolidation may involve moving products from a partially empty peg (44*d*) to another partially empty peg (44*c*) and/or removing empty pegs (42*b*, 42*c*, 46*c*, 48*a*), and moving the remaining pegs into a more pleasing or user-friendly arrangement on display 40' as indicated in FIG. 7. Prior art pegboard displays make such rearrangement tedious, and the result may confuse customers who were familiar with the initial configuration and who have trouble reading the product information on a prior art placard arm. However, the peg display assemblies featuring the placard arms as described herein make such rearrangements easy to perform and to use. For example, the featured information regions 16*e* make locating desired products within the product display relatively easy.

In addition to facilitating the initial selection of a product from a pegboard display and the rearrangement of the display, the use of a placard arrangement as described herein makes management of the product display easier for the retailer. Should it be necessary to move the products from one pegboard to another, the pegs with their accompanying placard arms are quickly and easily grouped together by hanging pegs having the same product species information together. Moreover, individually identifying species on each peg and placard arm arrangement allows a retailer to mix product species as they chose to maximize the use of precious retailer space without worrying that consumer confusion will follow from the mixing of product species and sales will be lost.

It should be appreciated that all of the foregoing advantages can be provided with a placard that does not detract from the usable display space on the pegboard. For example, in the embodiment shown, the featured information region 16*e* extends into a portion of the display system (e.g., between rows and columns of displayed products) that is otherwise not used and further would not impede retrieval of a product hanging on a peg.

It should be appreciated that while the inventive placard device 10 is described as included within a pegboard display system, it is within the scope of the present invention to provide such a placard device in other types of product display systems. For example, the inventors have realized that all product display systems can be improved by employing a placard having the inventive arrangement of a product information region and a featured information region as the arrangement permits a retailer to visually display product species within product lines having a variety of species of products. In a particular embodiment, the featured information region 16*e* can extend from the generally rectangular product information region 16*d* to a position that does not intrude into the display space for an adjacent peg and placard. For example, placards having the inventive arrangement of a product information region and a featured information region may be utilized on product display systems that include a shelving system with the placards affixed to a forward portion of each shelf. Each shelf is dedicated to a different species of product to provide a display for that species of product. Optionally, a shelf may have a plurality of portions of the shelf, each portion providing a display for a different species of product and having an associated placard device, including a rectangular product information region 16*d* and a featured information region 16*e*, identifying each of the different species to prospective consumers.

In one embodiment of the present invention, as illustrated in FIGS. 9A-E, the inventive placard device 10 is incorporated into a merchandising device such as, for example, an end cap merchandising device 200. For example, a first portion 210 of the end cap merchandiser 200 includes a plurality of products (e.g., batteries) 202 hanging from pegs 110. As shown in, for example, FIG. 9D, the featured information region 16*e* improves an ability to locate individual species (e.g., differing battery sizes) within the product 202 displayed on the end cap merchandising device 200. In one aspect of the present invention, the end cap merchandising device 200 includes a second portion 220 such as, for example, a left hand side portion, that includes a first area 222 for displaying a plurality of products 224 by, for example, hanging the products 224 from pegs 110 and a second area 226 for displaying a plurality of products 228 by, for example, affixing the products 228 to one or more carousel display devices 230 (e.g., two carousel display devices shown).

As can be appreciated, integrating the display areas 222 and 226 having pegboard type 110 and a carousel 230 type display further improves the ability to differentiate species of products within a broad genus of products having different features (e.g., batteries having different sizes and uses). Further, the integrated carousel display devices 230 are seen to provide a more efficient use of space on the merchandising device 200 as a potential consumer may rotate or spin (e.g., in either a clockwise or counterclockwise direction) the carousel device 230 to display additional products stored in a plurality of cells or columns 232 on the carousel device 230 in an area of the merchandising device 200 that typically would only display one column of products (e.g., products hanging on pegs). That is, the carousel device 230 takes advantage of a depth of the merchandising display 200 that would otherwise be void by selectively storing and displaying products within the plurality of columns 232. Accordingly, the integrated pegboard display 110 and carousel display 230 of the second portion 220 of the end cap merchandising device 200 are seen as yet another improvement over the prior art display devices by selectively arranging the display of products to prospective consumers by product species and, where needed, expanding the display area with an integrated carousel display to accommodate a category of product (e.g., hearing aid batteries) having a number of larger species of product (e.g., various sizes within the specialized category of hearing aid batteries).

Figure 10:
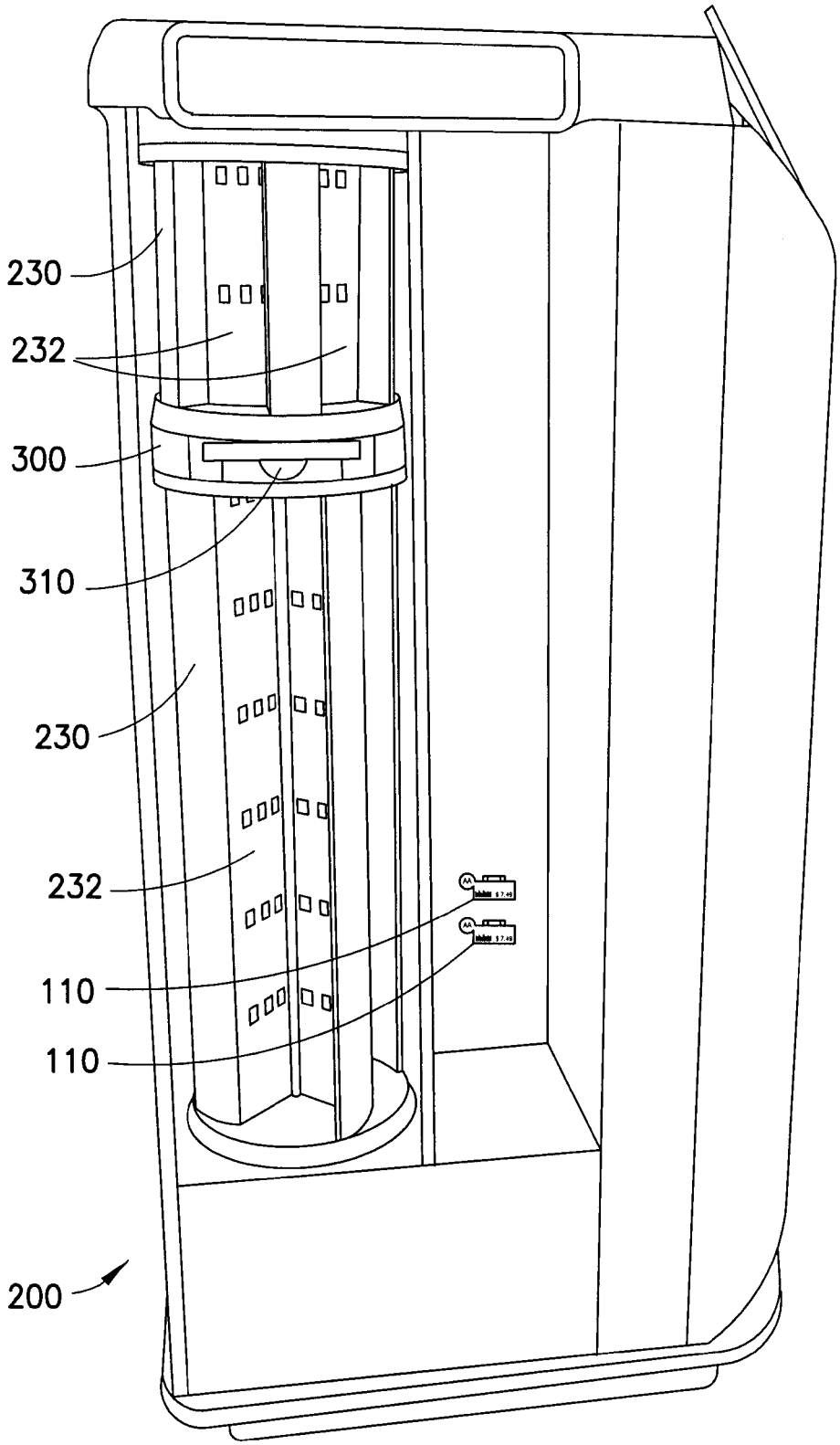
FIG. 10 is a left hand side view of an end cap merchandising device incorporating, in accordance with one embodiment of the present invention, the inventive placard device and an inventive carousel display device.

FIG. 10 illustrates one embodiment of the end cap merchandising display device 200 having, for clarity purposes, no product displayed thereon. The carousel display devices 230 includes the plurality of columns 232 for displaying various sizes (species) of products within a specialized family of products, for example, hearing aid batteries within the broad genus of general purpose battery power cells. As shown in FIG. 10, an information and/or promotional messaging unit 300 is disposed between a first carousel display 230 (e.g., an upper carousel display) and a second carousel display 230 (e.g., a lower carousel display). In one embodiment, illustrated in FIG. 11, the messaging unit 300 includes an interactive display or "shelf-talker" 310 disposed in a removable cassette 320 of a messaging housing 330 for providing textual, graphic, image, pictorial and/or other visual illustrations or representations of product and/or promotional information to prospective customers. In one embodiment, the messaging housing 330 is adapted to mate with corresponding surfaces of the first and second carousel displays 230. For example, an upper surface 332 of the housing 330 is configured to receive a lower surface of the first or upper carousel display 230 and a lower surface 334 of the housing 330 is configured to receive an upper surface of the second or lower carousel display 230 to form an integral assembly. It should be appreciated however, that it is within the scope of the present invention for a non-integral assembly of such components. FIG. 12 depicts a bottom plan view of the housing 330 illustrating a circular perimeter configured to accommodate the carousel displays 230 and a mouth 336 that provides a sliding interface for receiving the removable cassette 320. It should be appreciated that when assembled, the mouth 336 portion of the housing 330 is arranged to present the removable cassette 320 and the interactive shelf-talker 310 to prospective customers located in front of the merchandising display device 200.

Referring again to FIG. 11, the cassette 320 is disposed in (e.g., slid into) the mouth 336 portion of the housing 330. In one embodiment, a snap lock 322 is configured within an upper portion of the cassette 320. As the cassette 320 slides into the mouth 336, the snap lock 322 is disposed within a recess 338 in the upper surface 332 of the messaging housing 330. The snap lock 322 and recess 338 being adapted (e.g., by a friction fit, snap fit, or the like) to retain the removable cassette 320 within the messaging housing 330. To release the cassette 320, the snap lock 322 is depressed to, for example, expel the lock 322 from the recess 338. In one embodiment, the first or upper carousel device 230 includes a recess in a floor portion of the device 230 that is aligned with the recess 338 for access to the snap lock 322. In this manner, the first carousel device 230 must be rotated into alignment with the recess 338 so as to avoid an inadvertent expulsion of the removable cassette 320 from the mouth 336 portion of the housing 330.

Figure 11:
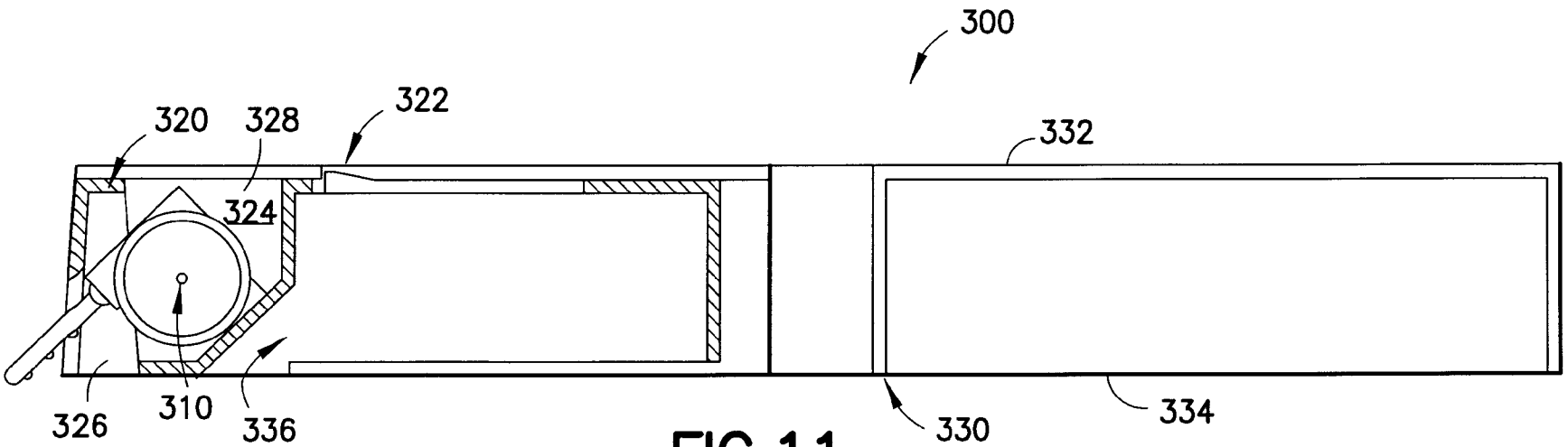
FIG. 11 is a side cross-sectional view of a messaging unit, in accordance with one embodiment of the present invention.
Figure 12:
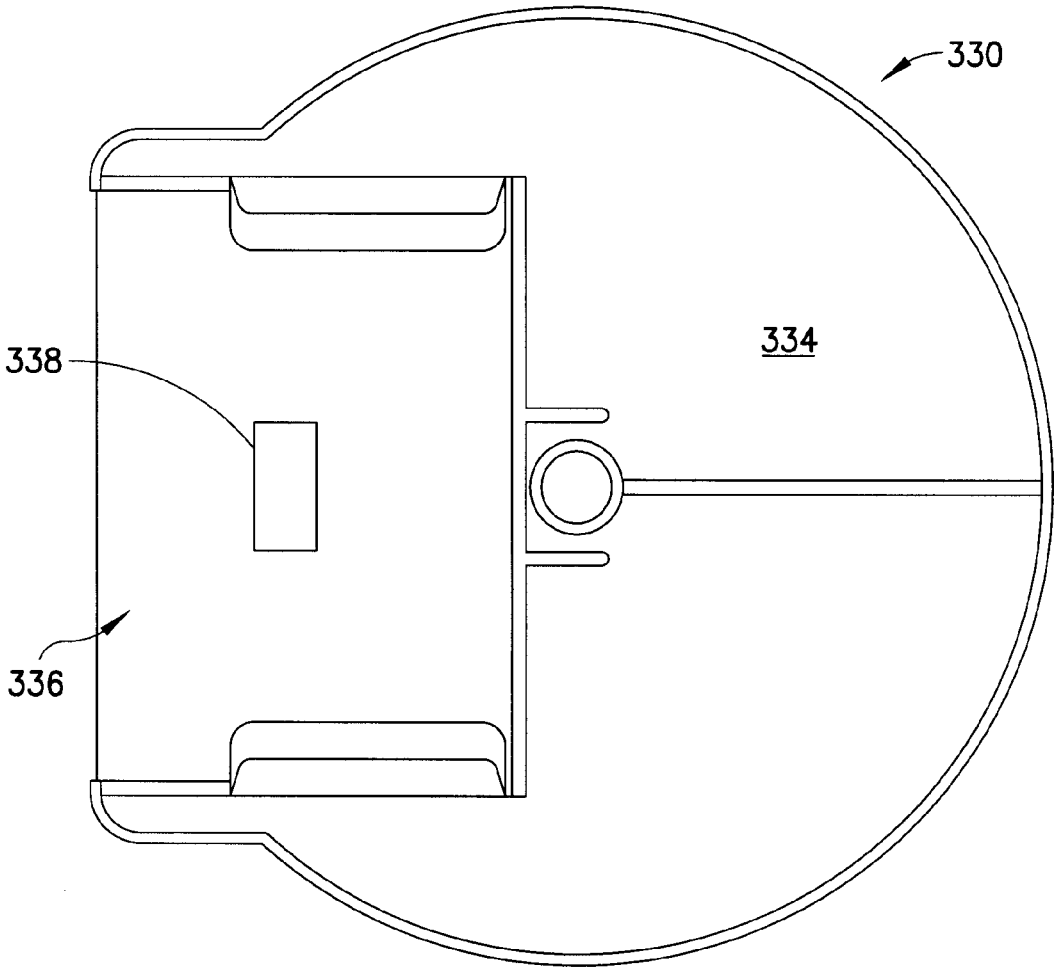
FIG. 12 is a bottom view of a message housing of the messaging unit of FIG. 11.

As shown in FIG. 11, the removable cassette 320 includes a chamber 324 configured to retain the shelf-talker display 310. The chamber 324 includes a first open end 326 such that a portion of the shelf-taker 310 extends out of the chamber 324 and is presented to prospective customers. The chamber 324 also includes a second open end 328. The second open end 328 provides access to the chamber 324 to, for example, retrieve or replace the shelf-talker display 310 disposed therein. In one embodiment, the interactive shelf-talker 310 includes, for example, a pull-down shade comprising wear and/or tear resistance material for presenting the aforementioned product and/or promotional information to customers. When the customer has finished their review, the shade retracts and is stored again within the removable cassette 320. An exemplary shelf-talker display may be purchased under the brand name INFOSHADE from, for example, AD-TECH LLC, El Segundo, Calif. USA. In one embodiment, the product and/or promotional information may include, for example, product operating instructions, safety and/or product warnings, and the like. When the carousel devices 230 display batteries, for example, the shelf-taker display 310 may provide instructions for installing the batteries in one or more products, comparison and/or cross-reference tables or other information demonstrating alternative brands and the like between various products and batteries to assist customers in selecting an appropriate battery size for their product, or the like.

It should be appreciated that it may be desirable to periodically revise or otherwise modify the product and/or promotional information provided by the shelf-talker display 310. Generally speaking, a significant amount of time and cost is expended to print, or otherwise customize a particular display. As such, it is desirable to rapidly implement (e.g., provide) the revised information to customers as soon as it is available. In one aspect of the invention, such a rapid implementation is easily achievable by store personnel that can access and remove the removable cassette 320 and replace it with either another cassette 320 including the revised shelf-talker 310 or access the chamber 324 to replace the shelf-talker display 310 with a revised display 310. As described above, this operation may be performed without any specialized tools, as the snap lock 322 may be depressed by, for example, a finger of store personnel or readily available writing instrument (e.g., a pen or pencil), paper clip, or like blunt object.

The terms "first," "second," and the like, herein do not denote any order, quantity, or importance, but rather are used to distinguish one element from another. In addition, the terms "a" and "an" herein do not denote a limitation of quantity, but rather denote the presence of at least one of the referenced item.

Although the invention has been described with reference to particular embodiments thereof, it will be understood by one of ordinary skill in the art, upon a reading and understanding of the foregoing disclosure, that numerous variations and alterations to the disclosed embodiments will fall within the spirit and scope of this invention and of the appended claims.

What is claimed is:

1. A product display device, comprising:

a support frame;

a plurality of display devices, each display device supports one or more products displayed thereon;

a pair of carousel display devices vertically aligned and independently rotatably mounted on the support frame, the pair of carousel display devices each includes a plurality of product display columns, each column includes one or more of the plurality of display devices mounted thereon;

a messaging unit disposed between a first one and a second one of the pair of carousel display devices, said messaging unit having a message housing, the messaging unit includes a removable interactive display cassette disposed in the message housing and provides at least one of textual, graphic, image, pictorial and visual illustrations and representations of product information and promotional information; and the first one of the pair of carousel display devices is disposed above an upper surface of the message housing and includes a floor portion having a recess in the floor portion, the upper surface of the message housing includes a recess, and when the recess in the floor portion of the first one of the pair of carousel display devices is aligned with the recess in the upper surface of the message housing the removable interactive display cassette is releasable from the message housing.

2. The product display of claim 1, wherein the messaging unit is fixedly mounted between the pair of carousel display devices and maintains an outward orientation as the pair of carousel display devices independently rotate relative to said messaging unit.

3. The product display of claim 1, wherein the message housing has an outwardly facing mouth, and the removable interactive display cassette is disposed within the mouth.

4. The product display of claim 1, wherein the plurality of display devices is comprised of a plurality of placard devices, each placard device includes a product peg, a placard and an attachment device, the placard is mounted to the attachment device and includes a product information region and a featured information region, the attachment device is mounted to the product peg, and each product peg supports the one or more products.

5. The product display of claim 4, wherein the attachment device includes a boom member having a foot portion, the placard is mounted to the boom member at a distal end of the boom member opposite the foot portion.

6. The product display of claim 5, wherein the placard is comprised of a front portion and a rear portion, the placard is mounted to the boom member by a placard hinge, the placard hinge forms a placard sleeve by folding the rear portion of the placard against the front portion.

7. The product display of claim 4, wherein the featured information region extends laterally away from the product information region and displays product species information, the product species information including at least one of a feature and a characteristic of each product in a line of products that is used by consumers when selecting a product from the line of products.

8. The product display of claim 7, wherein the at least one feature and characteristic includes a product's size, a product's type, promotional information, information identifying a product by the product's nutritional value, product rating and classification.

9. The product display of claim 7, wherein the plurality of product display columns display two or more products within the line of products having differing product species information.

10. The product display of claim 1, wherein the removable interactive display cassette includes an interior chamber and a shelf-talker is disposed in the interior chamber, the shelf-talker comprises a pull-down shade having product and/or promotional information affixed thereto.

11. The product display of claim 10, wherein the removable interactive display cassette includes a first open end such that the shelf-talker extends out of the interior chamber.

12. The product display of claim 11, wherein the removable interactive display cassette includes a second open end, the second open end provides access to the interior chamber and to the shelf-talker disposed therein.

13. A product display device, comprising:

a support frame;

a plurality of display devices, each display device supports one or more products displayed thereon;

a pair of carousel display devices vertically aligned and independently rotatably mounted on the support frame, the pair of carousel display devices each include a plurality of product display columns, each column includes one or more of the plurality of display devices mounted thereon;

a messaging unit disposed between a first one and a second one of the pair of carousel display devices, the messaging unit is fixed to maintain an outward orientation as the pair of carousel display devices independently rotate relative to the messaging unit, the messaging unit includes a removable interactive display for providing at least one of textual, graphic, image, pictorial and visual illustrations and representations of product information and promotional information; and the messaging unit further comprises:

a message housing having an upper surface, a lower surface, and an outwardly facing mouth, the upper surface of the message housing receives a lower surface of the first one of the pair of carousel display devices and the lower surface of the message housing receives an upper surface of the second one of the pair of carousel display devices, the upper surface of the message housing having a recess disposed in proximity to the mouth; and a removable display cassette disposed in the mouth of the message housing, the display cassette having an upper surface and an interior chamber, the upper surface having a lock portion, the lock portion cooperates with the recess of the upper surface of the message housing to fixedly retain the removable display cassette within the mouth;

the removable interactive a shelf taker display is disposed in the interior chamber of the removable display cassette.

14. The product display of claim 13, wherein the first one of the pair of carousel display devices includes a floor portion and a recess in the floor portion, and when the recess in the floor portion of the first one of the carousel display devices is aligned with the recess in the upper surface of the message housing the lock portion is accessible to release the removable display cassette from the mouth of the message housing.

15. The product display of claim 13, wherein the removable display cassette further includes a recess in the upper surface in proximity to the interior chamber to provide access to the interior chamber and the removable interactive display disposed therein.

16. The product display of claim 13, wherein the removable interactive display is comprised of a shelf-talker, the shelf talker comprises:

a pull-down shade having product and/or promotional information affixed thereto.

17. The product display of claim 13, wherein the plurality of display devices is comprised of a plurality of placard devices, each placard device includes a product peg, a placard and an attachment device, the placard has a product information region and a featured information region, the attachment device mounts the placard device on the product peg, and each product peg supports the one or more products.

18. The product display of claim 17, wherein the featured information region extends laterally away from the product information region and displays product species information, the product species information including at least one of a feature and a characteristic of each product in a line of products that is used by consumers when selecting a product from the line of products.

19. The product display of claim 18, wherein the at least one feature and characteristic includes a product's size, a product's type, promotional information, information identifying a product by the product's nutritional value, product rating and classification.

20. The product display of claim 18, wherein the plurality of product display columns display two or more products within the line of products having differing product species information.

* * * * *